United States Patent [19]

Adachi

[11] 4,238,985

[45] Dec. 16, 1980

[54] ELECTRONIC MUSICAL INSTRUMENT

[75] Inventor: Takeshi Adachi, Hamamatsu, Japan

[73] Assignee: Nippon Gakki Seizo Kabushiki Kaisha, Hamamatsu, Japan

[21] Appl. No.: 942,723

[22] Filed: Sep. 15, 1978

Related U.S. Application Data

[63] Continuation of Ser. No. 770,718, Feb. 22, 1977, abandoned.

[30] Foreign Application Priority Data

Feb. 27, 1976 [JP] Japan ..... 51/21327

[51] Int. Cl.[3] ..... G10H 1/12; G10H 1/18

[52] U.S. Cl. ..... 84/1.01; 84/1.19; 84/1.27; 84/DIG. 8; 84/DIG. 9

[58] Field of Search ..... 84/1.01, 1.11, 1.13, 84/1.19, 1.22, 1.24–1.27, DIG. 2, DIG. 8, DIG. 9

[56] References Cited

U.S. PATENT DOCUMENTS

| | | | |
|---|---|---|---|
| 3,767,833 | 10/1973 | Noble et al. | 84/1.01 |
| 3,828,110 | 8/1974 | Colin | 84/1.01 |
| 3,886,834 | 6/1975 | Okamoto | 84/1.19 X |
| 3,886,836 | 6/1975 | Hiyoshi | 84/1.26 |
| 3,898,905 | 8/1975 | Schreier | 84/1.01 |
| 3,906,830 | 9/1975 | Mathias | 84/1.01 |
| 3,948,139 | 4/1976 | Melcher et al. | 84/1.19 |
| 4,050,343 | 9/1977 | Moog | 84/1.01 |
| 4,077,294 | 3/1978 | Hiyoshi et al. | 84/1.24 X |
| 4,080,862 | 3/1978 | Hiyoshi et al. | 84/1.24 |
| 4,083,283 | 4/1978 | Hiyoshi et al. | 84/1.24 |
| 4,119,005 | 10/1978 | Kondo et al. | 84/1.01 |
| 4,133,244 | 1/1979 | Hiyoshi et al. | 84/1.26 |
| 4,166,405 | 9/1979 | Hiyoshi et al. | 84/1.24 |

*Primary Examiner*—Stanley J. Witkowski
*Attorney, Agent, or Firm*—Ladas & Parry

[57] ABSTRACT

An electronic musical instrument of a type capable of producing a musical tone corresponding to the tone pitch of a depressed key by controlling oscillation frequency of a voltage-controlled type oscillator by a pitch voltage corresponding to the tone pitch, wherein musical tone elements such as tone pitch and tone color are controlled in accordance with a control voltage which is produced for each individual key but is different from the pitch voltage.

A temperature curve can be determined by controlling the tone pitch of the musical tone by this control voltage as well as by the pitch voltage. A desired temperament curve can be obtained by suitably adjusting the values of the control voltage for the respective keys. The tone color control is effected by varying the cut-off frequency of the voltage-controlled type filter in accordance with the aforementioned control voltage.

6 Claims, 7 Drawing Figures

KEY CORRESPONDING CONTROL VOLTAGE GENERATOR
11
NC1 ... NC4 OC1 .. OC3
H1 ... H8
CV1
CV3
CV8
TONE FORMING UNIT
24-1
24-2
24-8
CV2
KV1
KV2
KV8
S/H
20-1
20-2
20-8
KV
OCTAVE GATE
16
6 5 1
12-2
NOTE GATE
14
B A# C
12-1
+V
TO GENERATOR 11
H1
H2
H8
OCTAVE DECODER
17
NOTE DECODER
15
C C# A# B
DECODER
21
TO GENERATOR 11
TO GENERATOR 11
NC1 NC2 NC3 NC4 OC1 OC2 OC3
SYNCHRONIZER
19
CHANNEL COUNTER
22
ΦCH
10
KEYBOARD CIRCUIT
13
KEY ASSIGNER
18
CLM
RLS
KEY-ON SIGNAL GENERATING SECTION
23
KO1
KO2
KO7
KO8

ELECTRONIC MUSICAL INSTRUMENT

This is a continuation, of application Ser. No. 770,718 filed Feb. 22, 1977, and now abandoned.

BACKGROUND OF THE INVENTION

This invention relates to an electronic musical instrument and, more particularly, to an electronic musical instrument of a type wherein voltage-controlled type circuits are employed to control tone pitch, tone color and volume of a musical tone.

In an electronic instrument of a type which is called a music synthesizer, voltage corresponding to the tone pitch of each key on a keyboard (hereinafter referred to as "pitch voltage") is produced in response to depression of the key. Controlling a voltage-controlled type oscillator by this pitch voltage, a tone source signal of a frequency corresponding to the pitch of the depressed key is produced. The pitch voltage corresponding to each key is determined in a suitable circuit such as a voltage dividing circuit. The pitch voltage, however, is fixedly determined in accordance with a regular tone pitch of a selected temperament, e.g., an equal temperament, and cannot be changed. Accordingly, a musical scale obtainable from a conventional musical synthesizer is limited to one of a temperament preset in a pitch voltage generation circuit, e.g., an equal temperament scale.

Since the pitch voltage of each key is fixedly determined in accordance with a predetermined temperament scale, a musical tone element for control of which the pitch voltage is utilized is extremely limited. More specifically, the pitch voltage has heretofore been utilized only for controlling the cut-off frequency of a voltage-controlled type filter except for the aforementioned oscillation of the tone source signal.

SUMMARY OF THE INVENTION

It is, therefore, an object of the present invention to increase musical tone elements which can be automatically and variably controlled in accordance with a depressed key and thereby affords richness in variety to the performance of the electronic musical instrument. In this specification "musical tone elements" or "elements of the electronic musical instrument" signifies elements such as tone pitch, tone color and volume which are controlled in accordance with a temperament scale, a tone source waveform, a cut-off frequency of a filter, a maximum level and duration time of attack or decay of an amplitude envelope etc.

It is another object of the invention to provide an electronic musical instrument capable of selecting as desired a temperament curve of a tone source signal oscillated from a voltage-controlled type oscillator.

These and other objects and features of the invention will become apparent from the description made hereinbelow with reference to the accompanying drawings.

DESCRIPTION OF A PREFERRED EMBODIMENT

Figure 1:
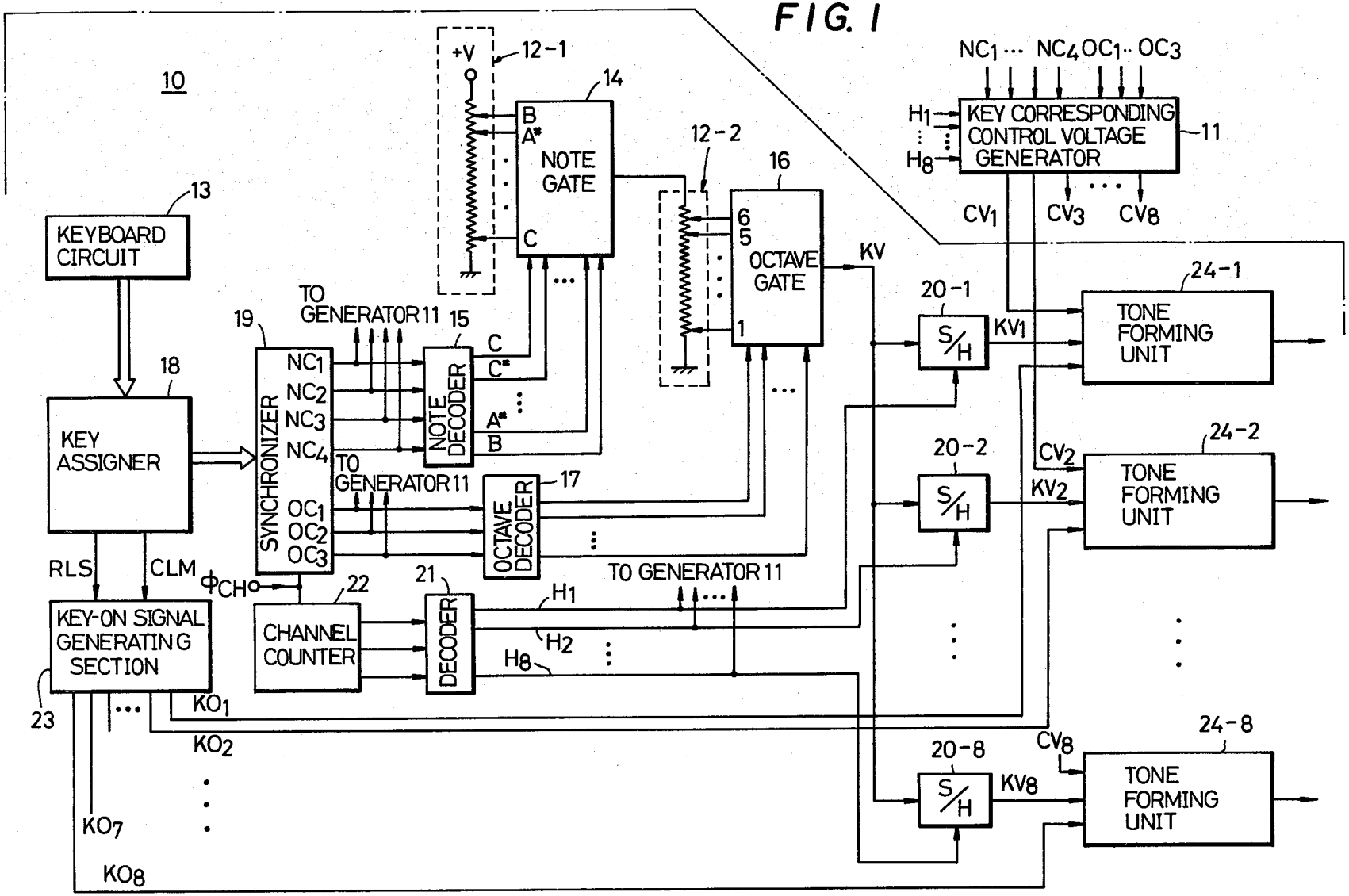
FIG. 1 is a block diagram showing one preferred embodiment of the electronic musical instrument according to the present invention.

Referring first to FIG. 1, a device 10 enclosed in a chain and not line constitutes a main portion of an electronic musical instrument of a type which produces a musical tone in accordance with a pitch voltage corresponding to a depressed key. According to this electronic musical instrument, a plurality of tones can be produced simultaneously. Before describing a key corresponding control voltage generator 11 which is provided for generating a control voltage for each individual key and constitutes an essential part of the present invention, description will be briefly made about the device 10.

In the device 10, pitch voltage generation circuits 12-1 and 12-2 produce a pitch voltage corresponding to the tone pitch for each key represented by a keyboard circuit 13. The circuit portion 12-1 produces voltage corresponding to frequency of each of twelve notes C, $C_{\#}$, . . . $A_{\#}$, B within one octave (e.g. the highest octave). A note gate circuit 14 delivers out voltage corresponding to a required note in response to a corresponding one of gate control signals each representing each individual note supplied from a note decoder 15 and feeds this note voltage to the circuit portion 12-2 as a power voltage to be divided. The circuit portion 12-2 divides the supplied voltage for each octave thereby producing voltages corresponding, for example, to the frequencies of the particular note for respective octaves ranging from the first through the sixth octaves. An octave gate circuit 16 delivers voltage corresponding to a required octave from the circuit portion 12-2 in response to a corresponding one of gate control signals each representing each individual octave supplied from an octave decoder 17. The voltage thus delivered out of the pitch voltage generation circuits 12-1 and 12-2 through the note gate circuit 14 and the octave gate circuit 16 constitutes pitch voltage KV representative of the frequency for the key depressed in the keyboard circuit 13. The keyboard circuit 13 has a plurality of key switches respectively interlocked with the keys in the keyboard and, upon detection of ON-OFF states of respective key switches, supplies information of the key switch or switches which are ON to a key assigner 18.

The key assigner 18 produces a key code (binary information) representing the key switch corresponding to the depressed key based on the information of the key switch being ON, assigns a musical tone corresponding to the key switch to a predetermined channel and delivers out the key code corresponding to the depressed key assigned to each channel in a time-sharing manner. The key assigner 18 is adapted also to produce in time sharing a claim signal CLM representing that the key is depressed in the particular channel or a release signal RLS representing that the key has been released in the channel in synchronism with the delivery of the key code.

The key code thus produced consists of a combination of 4 bits of note code $NC_1$, $NC_2$, $NC_3$ and $NC_4$ representing the note of the key and 3 bits of octave code $OC_1$, $OC_2$ and $OC_3$ representing the octave range to which the depressed key belongs.

As the key assigner 18, one disclosed in the specification of U.S. Pat. No. 3,882,751 issued on May 13, 1975 may be employed. One example of the key codes is shown in the following Table.

The key codes thus delivered from the key assigner 18 upon depressing of plural keys are sequentially applied to a synchronization circuit 19.

| | | key code | | | | | | |
|---|---|---|---|---|---|---|---|---|
| | octave | note code | | | | octave code | | |
| note | range | $NC_4$ | $NC_3$ | $NC_2$ | $NC_1$ | $OC_1$ | $OC_2$ | $OC_3$ |
| C# | | 0 | 0 | 0 | 0 | | | |
| D | | 0 | 0 | 0 | 1 | | | |
| D# | | 0 | 0 | 1 | 0 | | | |
| E | | 0 | 1 | 0 | 0 | | | |
| F | | 0 | 1 | 0 | 1 | | | |
| F# | | 0 | 1 | 1 | 0 | | | |
| G | | 1 | 0 | 0 | 0 | | | |
| G# | | 1 | 0 | 0 | 1 | | | |
| A | | 1 | 0 | 1 | 0 | | | |
| A# | | 1 | 1 | 0 | 0 | | | |
| B | | 1 | 1 | 0 | 1 | | | |
| C | | 1 | 1 | 1 | 0 | | | |
| | 1 | | | | | 0 | 0 | 0 |
| | 2 | | | | | 0 | 0 | 1 |
| | 3 | | | | | 0 | 1 | 0 |
| | 4 | | | | | 0 | 1 | 1 |
| | 5 | | | | | 1 | 0 | 0 |
| | 6 | | | | | 1 | 0 | 1 |

The synchronization circuit 19 sequentially delivers the respective key codes to decoders 15 and 17 at a low speed in synchronism with a low channel clock pulse $\phi_{CH}$.

The note decoder 15 decodes the note code $NC_1$–$NC_4$. The decoded output signals are applied to the note gate circuit 14 as gate control signals for the corresponding note.

The octave decoder 17 decodes the octave code $OC_1$–$OC_3$. The decoded output signal are applied to the octave gate circuit 16 as control signals for the corresponding octave. If, for example, the key corresponding to the note C in the second octave is depressed, the note code $NC_4$-$NC_1$ is "1110" and the octave code $OC_1$–$OC_3$ is "001". The note gate circuit 14 will thereupon provide a voltage corresponding to the note C while the octave gate circuit 16 will provide a pitch voltage KV corresponding to the note C in the second octave. The voltage KV is applied to a plurality of sample-hold circuits 20-1 to 20-8 and is held in one of the sample-hold circuits 20 to which any one of signals $H_1$ to $H_8$ is applied from a decoder 21 at the same timing. The sampling operation of the sample-hold circuits 20-1 to 20-8 corresponding to the respective channels (e.g. 8 channels) is controlled by the outputs $H_1$ to $H_8$ supplied from the decoder 21.

A channel counter 22 sequentially counts the low channel clock pulse $\phi_{CH}$ and produces a code output of 3-bits defining each of the eight channels. Accordingly, the decoder 21 sequentially produces output $H_1$ to $H_8$ on 8 output lines thereof in synchronism with the low channel clock pulse $\phi_{CH}$. The outputs of the decoder 21 are applied to the sample-hold circuits 20-1 to 20-8 of the respective channels as channel gate control signals $H_1$ to $H_8$ to cause the sample-hold circuits to sample the pitch voltage supplied from the octave gate circuit 16 in the channel represented by the channel gate control signal.

The period of the low channel clock pulses $\phi_{CH}$ is determined by taking into account time constant by the gate circuits 14 and 16 and a condenser (not shown) provided for holding the pitch voltage in the sample-hold circuits 20.

The condenser completes its charging in one period of the low channel clock pulses $\phi_{CH}$.

Since the state of each key switch is detected by a high rate clock in the keyboard circuit 13 and the key code corresponding to the depressed key is delivered at the same high clock rate in a time-sharing manner from the key assigner 18, the synchronization circuit 19 which receives the key code applied at the high clock rate is adapted to deliver out the key code at a low clock rate synchronous with the low channel clock pulse $\phi_{CH}$.

The key-on signal generating section 23 converts the claim signal CLM and the release signal RLS to static signals for each channel, produces key-on signal $KO_1$ to $KO_8$ representing that the key is depressed in the channel in which the claim signal CLM is present and applies these signals to tone forming units 24-1 to 24-8 in accordance with the respective channels.

The pitch voltages $KV_1$ to $KV_8$ stored in the sample-hold circuits 20-1 to 20-8 corresponding to the channels assigned by the key assigner 18 are applied to the tone forming units 24-1 to 24-8 for controlling a voltage-controlled type oscillator (not shown) which is adapted to oscillate a tone source signal corresponding to any of the pitch voltages $KV_1$ to $KV_8$. The key-on signal $KO_1$ to $KO_8$ are used in the tone forming units 24-1 to 24-8 for generating thereupon an amplitude envelope of the musical tone or an envelope of cut-off frequency variations of the filter.

The key corresponding control voltage generator 11 receives from a synchronization circuit 19 the note code $NC_1$–$NC_4$ and the octave code $OC_1$–$OC_3$ representative of the depressed key produced in time sharing in synchronism with a channel, i.e., a time slot, to which generation of the musical tone of the depressed key is allotted and, in response to these codes, produces one of control voltages $CV_1$–$CV_8$ corresponding to the key represented by these codes in accordance with a channel to which generation of the musical tone of the key is allotted.

Figure 2:
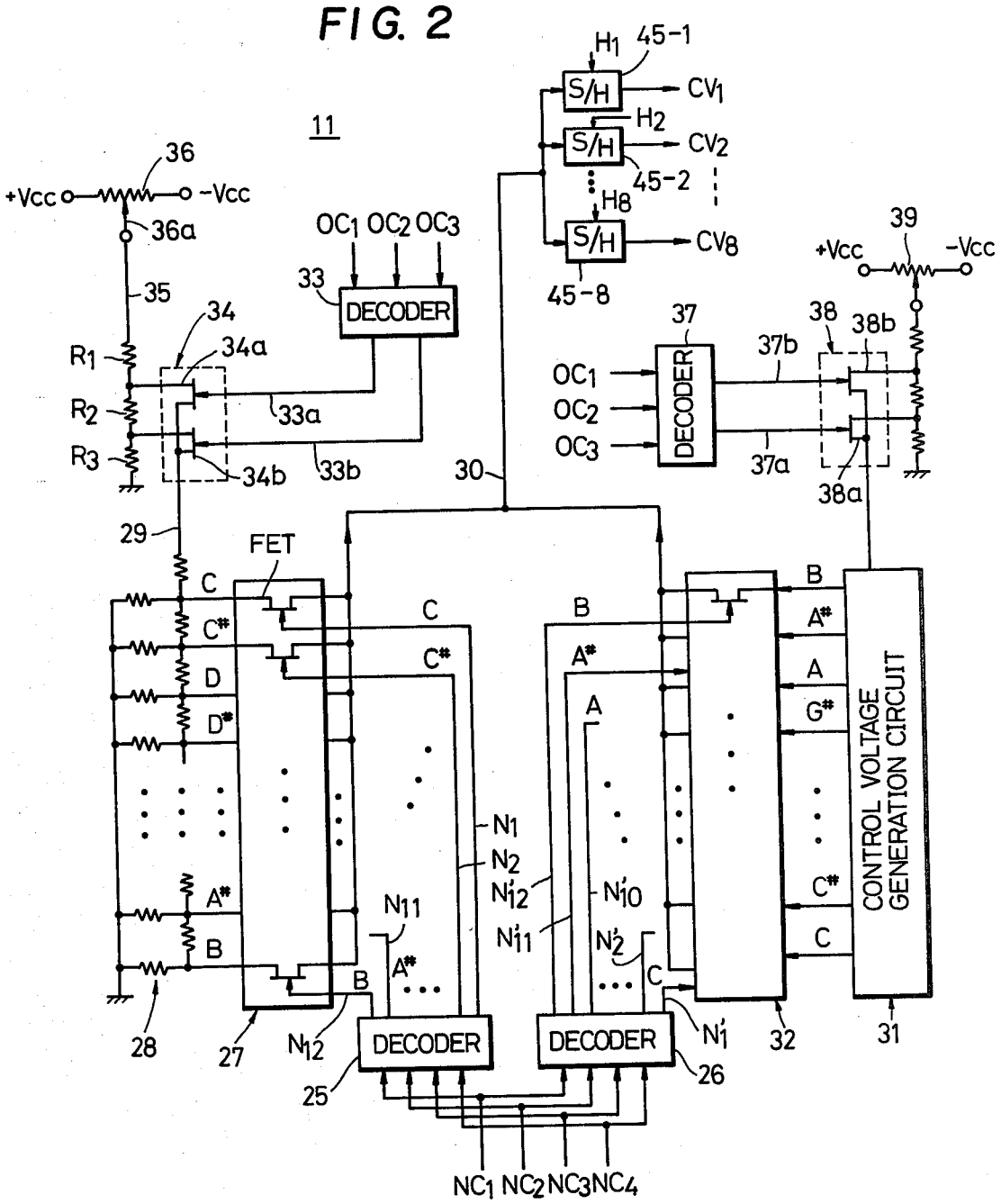
FIG. 2 is a block diagram showing in detail an example of a key corresponding control voltage generator which constitutes an essential portion of the electronic musical instrument.
Figure 3:
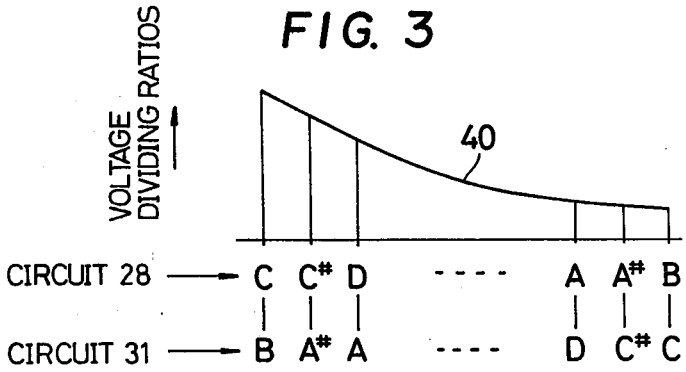
FIG. 3 is a graphical diagram showing an example of a function of the key corresponding control voltage with its abscissa representing note names (variable) which function represents contents of voltage dividing ratio set in control voltage generation circuits 28 and 31.

FIG. 2 shows an example of the key corresponding control voltage generator 11 in detail. The note code $NC_1$–$NC_4$ is decoded by decoders 25 and 26 and thereupon a signal "1" is provided on one of twelve output lines $N_1$–$N_{12}$ and also one of twelve output lines $N_1'$–$N_{12}'$ of the respective decoders in accordance with the note C, $C_\#$, . . . $A_\#$ or B represented by the note code. A gate 27 comprises twelve analog gates each consisting, for example, of a field-effect transistor FET and corresponding to one of the twelve notes. Each of the analog gates is gate-controlled by the signal provided via one of the output lines $N_1$–$N_{12}$ of the decoder 25. A control voltage generation circuit 28 consists of a voltage dividing circuit composed by connecting a plurality of resistors. Voltage to be divided is supplied via a line 29. The circuit 28 has twelve voltage dividing points. Resistance value of each resistor constituting the circuit 28 is so determined that voltage dividing ratios at respective voltage dividing points as a whole will form a continuous change (i.e. functional change) such as in shown by a curve 40 in FIG. 3. Each of the voltage dividing points of the circuit 28 is connected to one of the respective analog gates of the gate 27 and, accordingly, voltage at one of the voltage dividing point is delivered out on a line 30 by the output of the decoder 25. In the example shown, the highest voltage divided output of the circuit 28 is gated by the signal provided via the line $N_1$ corresponding to the note C, the lowest voltage divided output by the signal on the line $N_{12}$ corresponding to the note B and the voltage divided outputs therebetween by the signals on the lines $N_2$–$N_{11}$ corresponding to the notes $C_\#$–$A_\#$.

A control voltage generation circuit 31 is of the same construction as the circuit 28. The outputs from the twelve voltage dividing points are connected to twelve analog gates FET of a gate 32 corresponding to the respective notes C-B and voltage selected by a signal on the output lines $N_1'$–$N_{12}'$ of the decoder 26 is delivered out on the line 30. In the example shown, the highest voltage divided output of the circuit 31 is gated by the signal on the line $N_{12}'$ corresponding to the note B, the lowest voltage divided output by the signal on the line $N_1'$ corresponding to the note C and the voltage divided outputs therebetween by the signals $N_2'$–$N_{11}'$ corresponding to the notes $C_\#$–$A_\#$. Accordingly, the voltage divided outputs are delivered out in mutually opposite directions in the control voltage generation circuits 28 and 31.

The octave code $OC_1$–$OC_3$ is applied to decoders 33 and 37. The decoder 33 produces an output "1" on a line 33*a* when the code $OC_1$–$OC_3$ is one which represents the first octave (i.e., "000") and produces an output "1" on a line 33*b* when the code $OC_1$–$OC_3$ is one which represents the second octave (i.e., "001"). Accordingly, an analog gate 34*a* of a gate 34 is brought into conduction to gate out voltage obtained by dividing power voltage supplied on a line 35 by resistors $R_1$–$R_3$ at a dividing ratio of $$\frac{R_2 + R_3}{R_1 + R_2 + R_3}.$$

Thus, the voltage divided output is supplied to the control voltage generation circuit 28 through the line 29. In the case of the second octave, the analog gate 34*b* is brought into conduction to gate out voltage obtained by dividing the power voltage supplied on the line 35 at a dividing ratio of $$\frac{R_3}{R_1 + R_2 + R_3}$$

to the line 29. Assuming, for example, that resistance value of the resistor $R_2$ is equal to that of the resistor $R_3$, the absolute value of the voltage provided on the line 29 in the case of the first octave is twice as large as that provided in the case of the second octave. Accordingly, the absolute value of the voltage derived from the control voltage generation circuit 28 in accordance with the note name of the first octave and supplied on the line 30 is larger than that derived in the case of the second octave. For instance, as shown in FIG. 4, the absolute value of the voltage provided on the line 30 (i.e. the key corresponding control voltage) substantially continuously decreases as the tone pitch rises from the first octave to the second octave.

A regulator 36 provided for supplying voltage to the line 35 consists of a potentiometer to which a positive power source +Vcc and a negative power source −Vcc are applied at respective ends of the resistance element thereof. If a movable slider 36*a* of the regulator 36 is set at the extreme end position on the side of the positive power source source +Vcc, the voltage (positive voltage) provided on the line 30 changes continuously in accordance with the respective keys as shown by a curve 41 in FIG. 4. If the movable slider 36*a* is set at the extreme end position on the side of the negative power source −Vcc, the voltage (negative voltage) provided on the line 30 changes in accordance with the respective keys as shown by a curve 42 in FIG. 4. Accordingly, the voltage produced by the circuit 28 can be adjusted within a range between the curves 41 and 42 shown in FIG. 4 in the case of the first and second octaves.

The decoder 37 produces an output "1" on a line 37*a* when the octave code $OC_1$–$OC_3$ is the fourth octave (i.e., "011") and an output "1" on a line 37*b* when the octave code is the fifth octave. Accordingly, an analog gate 38*a* of the gate 38 is brought into conduction in the case of the fourth octave and an analog gate 38*b* is brought into conduction in the case of the fifth octave. Voltage obtained by dividing the voltage provided by a regulator 39 is picked from the analog gate 38*a* or 38*b* and is supplied to the control voltage generation circuit 31. Since the voltage provided by the gate 38*a* is lower than the voltage provided by the gate 38*b*, the absolute value of the voltage delivered from the circuit 31 to the line 30 in the case of the fourth octave in accordance with the respective notes is smaller than that of the voltage delivered in the case of the fifth octave. As is shown in FIG. 4, as the tone pitch rises from the fourth octave to the fifth octave, the absolute value of the voltage provided on the line 30 (i.e., the key corresponding control voltage) increases substantially continuously.

Figure 4:
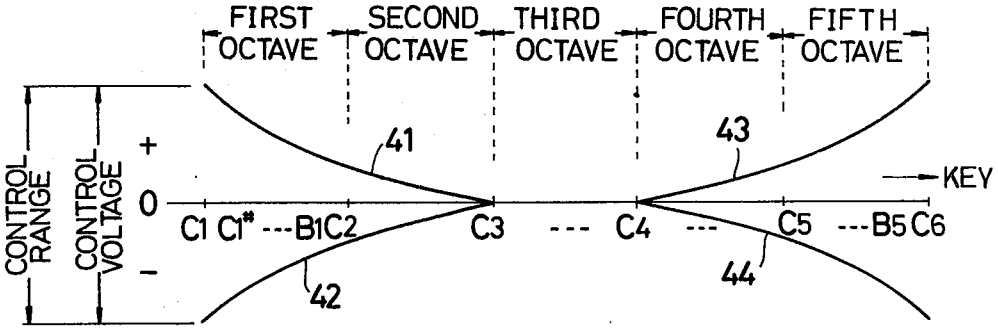
FIG. 4 is a graphical diagram showing characteristic curves and an adjustable range of the key corresponding control voltage ranging over the entire keyboard realizable in the circuits of FIG. 2.

The regulator 39 is of the same construction as the regulator 38 and, accordingly, the voltage produced by the control voltage generation circuit 31 can be adjusted within a range defined by lines 43 and 44 in FIG. 4 in the case of the fourth and fifth octaves.

In the example shown in FIG. 4, the key corresponding control voltage is zero, i.e., no control voltage is produced, in the case of the third octave. By adopting this construction in which the control voltage is produced not in the intermediate octave range but in the low and high octave ranges (i.e., the key corresponding control voltage is produced in a desired octave range), a complicated musical tone effect can be produced by a tone control to be described later.

If the electronic musical instrument is capable of playing a note of the six octave, an analog gate for the sixth octave should be added to the gate 38.

It is of course possible to construct the circuit so that a control voltage may be produced in the third or other desired octave range. The circuit construction to be employed in that case will be obvious from the foregoing description.

Since the note code $NC_1$–$NC_4$ and the octave code $OC_1$–$OC_3$ used for controlling the gates 27, 32, 34 and 38 are ones which have already been assigned in a time sharing fashion to predetermined channels in the key assigner 18, control voltage corresponding to the depressed key is supplied to the line 30 at its assigned channel time in time sharing. The voltage signal on the line 30 is applied to the sample hold circuits 45 and is distributed to a particular channel by operating the sample hold circuits 45-1 through 45-8 in response to the channel gate control signals $H_1$–$H_8$ and in synchronism with the respective channels. The control voltage $CV_1$, $CV_2$ . . . or $CV_8$ corresponding to the depressed key which has been assigned to the particular channel and being held in one of the sample hold circuit 45-1 through 45-8 is applied to one of the tone forming units 24-1 through 24-8 and is used therein for controlling various elements of the musical tone with respect to each key.

Figure 5:
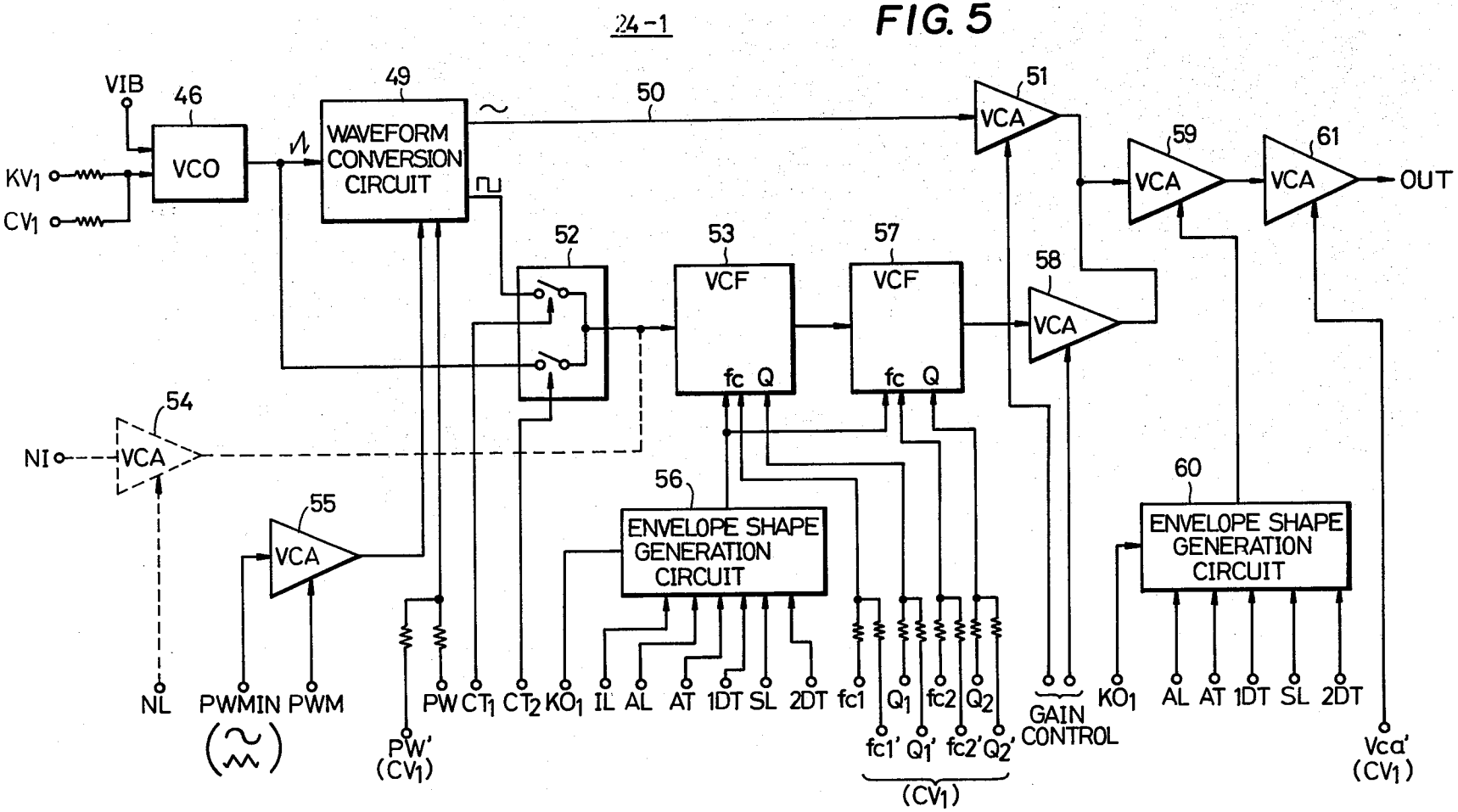
FIG. 5 is a block diagram showing an example of a tone forming unit of FIG. 1 with respect to one channel only.

An example of the tone forming units 24-1 through 24-8 is shown in detail in FIG. 5. In FIG. 5, only one channel (24-1) is illustrated but the other channels (24-2 through 24-8) have the same construction.

Figure 6:
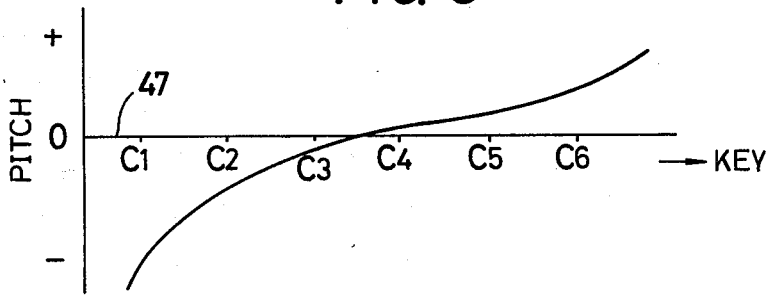
FIG. 6 is a graphical diagram showing schematically temperament curves of an equal temperament and a piano temperament.

The key corresponding control voltage $CV_1$ is mixed through resistance with the pitch voltage $KV_1$ and thereafter is applied to the control input of a voltage-controlled type oscillator (VCO) 46. Hence a tone source signal (e.g. a saw-tooth waveform signal) of a frequency corresponding to voltage obtained by adding the voltage $KV_1$ and the voltage $CV_1$ together ($KV_1+CV_1$) is produced by the oscillator 46. If the regulators 36 and 39 (FIG. 2) are set at ground potential, the control voltage $CV_1$ is 0 volt irrespective of the note name of the key and the oscillation frequency of the voltage-controlled type oscillator 46 is determined by the pitch voltage $KV_1$. In such a state, if pitch voltages corresponding to the respective keys are predetermined in the pitch voltage generation circuit 12-1, 12-12 (FIG. 1) so as to play an equally tempered scale, the scale played by this electronic musical instrument is an equally tempered scale as shown by line 47 in FIG. 6. FIG. 6 shows the key name in the abscissa and, in the ordinate, the pitch deviation of the fundamental frequency of each key relative to the equally tempered scale which is taken as reference (i.e. 0).

If it is desired to adjust the temperament in the performance of the electronic musical instrument, control voltage $CV_1$ of a suitable value is generated for each of the respective keys by operating the regulators 36 and 39 so as to obtain a desired temperament curve. For example, a temperament curve of piano tends to fall in the pitch in the low octave range and rise in the high octave range as compared with the equally tempered scale as shown by a curve 48 in FIG. 6. Assuming that the voltage-controlled type oscillator 46 is of a type which oscillates higher frequencies as the control input voltage increases, a relative large negative voltage should be supplied from the regulator 36 for the low octave range and a relatively small positive voltage from the regulator 39 for the high octave range in order to obtain a temperament curve as shown by the curve 48 in FIG. 6. According to this arrangement, a negative control voltage $CV_1$ is produced in the low octave range (i.e. the first and second octaves) in accordance with a characteristic curve similar to the curve 42 in FIG. 4 and this voltage is subtracted from the value of the pitch voltage $KV_1$ with a result that a scale of a lower pitch than the equal temperament is produced. On the other hand, a positive control voltage $CV_1$ is produced in the high octave range (i.e., the fourth and fifth octaves) in accordance with a characteristic curve which is more gradual than the curve 43 in FIG. 4 and this voltage is added to the pitch voltage $KV_1$ with a result that a scale of a higher pitch than the equal temperament is produced. Thus, a scale which is a close simulation of the temperament curve of piano can be obtained. It will be apparent from the foregoing description that a scale of any desired temperament other than the piano temperament can be obtained within the adjustment range of the control voltage $CV_1$.

If vibrato is to be imparted to the tone, a vibrato control signal VIB is supplied to the voltage-controlled type oscillator 46. The tone source saw-tooth waveform signal is converted into a sine wave and a rectangular wave in a waveform conversion circuit 49. The sine wave signal is applied to a voltage-controlled type amplifier (VCA) 51 through a line 50 whereas the rectangular wave signal is applied to a voltage-controlled type filter (VCF) 53 if the rectangular wave signal is selected by a signal $GT_1$ in a select circuit 52. A signal $GT_2$ selects the saw-tooth waveform signal in the select circuit 52 for supplying it to the filter 53. If a noise signal NI is used, the noise level is suitably controlled by a noise level control voltage signal NL in a voltage-controlled type amplifier (VCA) 54 and thereafter is applied to the filter 53.

Duty factor of the rectangular wave signal obtained in the waveform conversion circuit 49 is controlled by a duty factor control voltage PW. The control voltage PW′ corresponding to the key corresponding control voltage $CV_1$ is mixed with the voltage PW and thereafter is supplied to the circuit 49. By this arrangement, the duty factor of the rectangular wave signal (corresponding to the frequency of the depressed key) can be changed in accordance with the depressed key whereby the harmonic components contained in the signal can be changed.

If the duty factor is to be changed periodically, a pulse width modulating signal PWMIN (e.g. a sine wave) is suitably controlled in a voltage-controlled type amplifier (VCA) 55 in response to a gain control voltage PWM and thereafter is applied to the waveform conversion circuit 49.

The voltage-controlled type filter 53 consists, for example, of a low-pass filter and its cut-off frequency is controlled by an envelope-like, time-variant cut-off frequency control voltage supplied by an envelope shape generation circuit 56. The filter 53 also receives another cut-off frequency control voltage $f_{c1}$ (used, for example, for controlling a constant tone color) and voltage $Q_1$ for controlling quality factor Q of the filter 53. A control voltage $f_{c1}'$ or $Q_1'$ corresponding to the key corresponding control voltage $CV_1$ is mixed with the voltage $f_{c1}$ or $Q_1$ and thereafter is applied to the filter 53. This arrangement is made to change the cut-off frequency and quality factor of the low-pass filter in accordance with the depressed key and thereby produce a complicated tone color variation.

The output of the filter 53 is applied to a voltage-controlled type filter (VCF) 57. The filter 57 is a high-pass filter and receives from the envelope generation circuit 56 a control voltage which changes the out-off frequency with time and also receives a cut-off frequency control voltage $f_{c2}$ (used, for example, for controlling a constant tone color) and a Q control voltage $Q_2$. Just as in the case of the filter 53, a control voltage $f_{c2}'$ or $Q_2'$ corresponding to the key corresponding control voltage $CV_1$ is mixed with the voltage $f_{c2}$ or $Q_2$ and thereafter is applied to the filter 57. This arrangement enables the cut-off frequency and quality factor of the filter 57 to be changed in accordance with the depressed key.

The output of the voltage-controlled type high-pass filter 57 is applied to a voltage-controlled type amplifier (VCA) 58. The sine wave signal applied to the voltage-controlled type amplifier 51 is substantially a fundamental wave component and the signal applied to the amplifier 58 is a signal in which harmonic components are suitably controlled. These tone signals are amplified at a suitable gain in the amplifiers 51 and 58 respectively and thereafter are mixed together to be applied to a voltage-controlled type amplifier 59. This amplifier 59 is provided for imparting an amplitude envelope of a musical tone. More specifically, the amplifier 59 provides the musical tone with amplitude envelope characteristics such as attack, decay and sustain with its gain being controlled by an envelope-like control voltage supplied by an envelope shape generation circuit 60. The musical tone signal thus having been controlled in the envelope amplitude is applied to a voltage-controlled type amplifier (VCA) 61. The gain of the amplifier 61 is controlled by a control voltage $CVC_a'$ corresponding to the key corresponding control voltage $CV_1$ so that a maximum amplitude of the amplitude envelope, i.e. volume of the produced tone, is controlled in accordance with the depressed key.

Each of the envelope shape generation circuits 56 and 60 produces an attack envelope upon receipt of a key-on signal $KO_1$ from the key-on signal generating section 23 and, after maintaining sustain level, produces a decay envelope extinguishment of the key-on signal $KO_1$. Thus, each of the circuits 56 and 60 generates an envelope shape having a series of attack, sustain and decay. In the circuit 56, an initial level control signal IL applied thereto determines a level at the time when the envelope starts, an attack level control signal AL a maximum level of a rise portion of the envelope, an attack time control signal TA attack duration, a first decay time control signal IDT duration of decay from finishing of attack to starting of sustain, a sustain level control signal SL a sustain level, and a second decay time control signal 2DT duration of decay after finishing of sustain. The same is the case with the envelope shape generation circuit 60. The shape of the envelope generated is controlled in various ways by these control signals. Accordingly, by applying the key corresponding control voltage $CV_1$ obtained in the key corresponding voltage generator 11 to the envelope shape generation circuits 56 and 60 for controlling desired envelope elements, tone color and volume can be changed with time in accordance with the depressed key.

Figure 7:
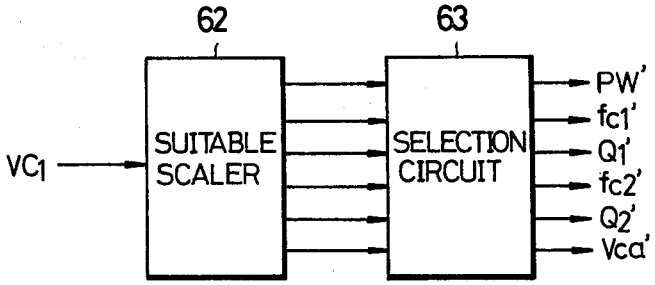
FIG. 7 is a block diagram showing an example of a circuit for changing and selecting the key corresponding control voltage for utilizing it in the circuit shown in FIG. 5.

The key corresponding control voltage $CV_1$ may be directly used as the control voltage PW', $fc_1'$, $Q_1'$, $f_{c2}'$, $Q_2'$ and $VC_a'$. Alternatively, the key corresponding control voltage $CV_1$ may be applied to a suitable scaler 62 as shown in FIG. 7 to suitably control its value and thereby obtain control voltages PW'-$VC_a'$ and these control voltages PQ'-$VC_a'$ may be suitably selected in a selection circuit 63 and supplied to the respective circuits of the tone forming unit 24-1.

In the example shown in FIG. 5, the pitch voltage $KV_1$ and the key corresponding control voltage $CV_1$ are added together and thereafter applied to the oscillator 46 for controlling the temperament scale of the electronic musical instrument. It should be noted, however, that the pitch voltage $KV_1$ itself can be controlled by the key corresponding control voltage $CV_1$. More specifically, by adding the signal on the line 30 (FIG. 2), in which the control voltages $CV_1$–$CV_8$ of the respective channels are multiplexed together, to the power voltage +V of the pitch voltage generation circuit 12-1 (FIG. 1), the pitch voltage $KV_1$ controlled by the control voltage $CV_1$ can be produced.

The key corresponding control voltage generator 11 is not limited to the construction shown in FIG. 2 but any construction capable of producing a preferably adjustable control voltage in accordance with the respective keys (i.e., key codes $NC_1$–$NC_4$, $OC_1$–$OC_3$) may be employed. The characteristic curves or the adjustable ranges of the control voltages corresponding to the respective keys are not limited to those shown in FIG. 4 but may suitably be determined. The foregoing description has been made with respect to a multi-tone musical instrument. The present invention however, is also applicable to a mono-tone musical instrument.

What is claimed is:

1. An electronic musical instrument comprising:

a plurality of keys, each key corresponding to a respective musical tone;

means for generating a pitch voltage corresponding to the octave and note of a depressed key, said pitch voltage having a value substantially defining the tone pitch of a musical tone signal corresponding to said depressed key;

means for generating, independently of said pitch voltage, a control voltage having a value assigned to said depressed key which is nondefinitive of said tone pitch;

means for generating the musical tone signal in response to said pitch voltage and including means for modifying such musical tone elements of said musical tone signal as tone pitch, tone color and tone volume; and means for directing said control voltage to said musical tone element modifying means to modify at least one of said musical tone elements of the musical tone signal at least partially in accordance with said control voltage, said musical tone element modifying means comprising means for varying an oscillation frequency of a voltage-controlled type oscillator in response to said control voltage, means for varying the duty factor of a rectangular wave conversion circuit connected to said voltage-controlled type oscillator in response to said control voltage, and means for varying cut-off frequencies of a low-pass filter and a high-pass filter connected in series at an output of said rectangular wave conversion circuit in response to said control voltage.

2. An electronic musical instrument comprising:

a plurality of keys, each key corresponding to a respective musical tone;

means for generating a pitch voltage corresponding to the octave and note of a depressed key and having a value substantially defining the tone pitch of a musical tone signal corresponding to said depressed key, said pitch voltage generating means comprising note voltage generation means for producing a note voltage defining the note-name of said depressed key and means for producing said pitch voltage by voltage-dividing said note voltage in accordance with the octave name of said depressed key;

means for generating, independently of said pitch voltage, a control voltage having a value assigned to said depressed key which is nondefinitive of said tone pitch;

means for generating the musical tone signal in response to said pitch voltage and including means for modifying such musical tone elements of said musical tone signal as tone pitch, tone color and tone volume; and means for directing said control voltage to said musical tone element modifying means to modify at least one of said musical tone elements of the musical tone signal at least partially in accordance with said control voltage.

3. An electronic musical instrument comprising:

a plurality of keys, each key corresponding to a respective musical tone;

means for generating a pitch voltage corresponding to the octave and note of a depressed key, said pitch voltage having a value substantially defining the tone pitch of a musical tone signal corresponding to said depressed key;

means for generating, independently of said pitch voltage, a control voltage having a value assigned to said depressed key which is nondefinitive of said tone pitch;

means for generating the musical tone signal in response to said pitch voltage and including means for modifying such musical tone elements of said musical tone signal as tone pitch, tone color and tone volume; and means for directing said control voltage to said musical tone element modifying means to modify at least one of said musical tone elements of the musical tone signal at least partially in accordance with said control voltage;

wherein said control voltage generating means comprises:

a first control voltage generation unit producing said control voltage with respect to each key in several octaves in a low octave range and comprising a first voltage dividing circuit including a plurality of resistors connected to each other and having voltage dividing points of a number equivalent to the number of note names, a circuit supplying when said depressed key is in said low octave range a source voltage in accordance with the octave name of said depressed key to said first voltage dividing circuit for voltage dividing, and a gate circuit connected to each voltage dividing point of said first voltage dividing circuit for delivering out voltage of a single one of the voltage dividing points corresponding to the depressed key;

a second control voltage generation unit producing said control voltage with respect to each key in several octaves in a high octave range and comprising a second voltage dividing circuit including a plurality of resistors connected to each other and having voltage dividing points of a number equivalent to the number of note names, a circuit supplying when said depressed key is in said high octave range a source voltage in accordance with the octave name of said depressed key to said second voltage dividing circuit for voltage dividing, and a gate circuit connected to each voltage dividing point of said second voltage dividing circuit for delivering out voltage of a single one of the voltage dividing points corresponding to the depressed key; and means for adjusting said source voltages of said first and second control voltage generation units in such a manner that said source voltages vary respectively over a range of opposite polarities and independently from each other.

4. In an electronic musical instrument of the type having pitch control means for establishing the pitch of a generated tone in response to a tone pitch determining voltage, and having one or more circuits for controlling the tonal quality of said generated tone in response to respective tonal quality control voltages applied thereto, the improvement comprising:

a tone pitch determining voltage generating circuit for supplying to said pitch control means a tone pitch determining voltage for a selected note, and a separate control voltage generator for producing a separate control voltage corresponding to said selected note, said separate control voltage being combined with one or more of said tone pitch determining voltage and said tonal quality control voltages to modify the corresponding tone pitch or tonal quality of said generated tone;

wherein said tone pitch determining voltage generating circuit is configured to generate tone pitch determining voltages which, when alone applied to said pitch control means, will cause the generation of tones of one musical scale, and wherein said separate control voltage generator is configured to produce separate control voltages which, when combined with said tone pitch determining voltages and applied to said pitch control means, will cause the generation of tones of a different musical scale.

5. In an electronic musical instrument of the type having pitch control means for establishing the pitch of a generated tone in response to a tone pitch determining voltage, and having one or more circuits for controlling the tonal quality of said generated tone in response to respective tonal quality control voltages applied thereto, the improvement comprising:

a tone pitch determining voltage generating circuit for supplying to said pitch control means a tone pitch determining voltage for a selected note;

a separate control voltage generator for producing a separate control voltage corresponding to said selected note, said separate control voltage being combined with one or more of said tone pitch determining voltage and said tonal quality control voltages to modify the corresponding tone pitch or tonal quality of said generated tone;

a keyboard having a plurality of depressible keys for note selection; and a key coder for providing a binary code identifying the note and octave of each depressed key, said tone pitch determining voltage generating circuit and said separate control voltage generator each being responsive to both note and octave information of said binary code.

6. An electrode musical instrument according to claim 5, wherein said separate control voltage generator is configured to provide separate control voltages of one polarity when the provided binary code designates that the depressed key is above a certain octave and to provide separate control voltages of the opposite polarity when the provided binary code designates that the depressed key is below said certain octave.

* * * * *